US006933845B2

(12) United States Patent
Howard

(10) Patent No.: US 6,933,845 B2
(45) Date of Patent: Aug. 23, 2005

(54) PHOTON INTRUSION DETECTOR

(75) Inventor: Robert James Howard, Clifton, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 238 days.

(21) Appl. No.: 10/409,335

(22) Filed: Apr. 8, 2003

(65) Prior Publication Data

US 2004/0201476 A1 Oct. 14, 2004

(51) Int. Cl.[7] ..... G08B 13/18

(52) U.S. Cl. ..... 340/556; 250/221; 250/227.14; 356/450

(58) Field of Search ..... 340/556, 557, 340/545.6, 550; 250/221, 227.14; 356/450

(56) References Cited

U.S. PATENT DOCUMENTS 3,987,428 A * 10/1976 Todeschini ..... 340/557
4,885,462 A 12/1989 Dakin
5,012,088 A 4/1991 Cole et al.
5,140,636 A 8/1992 Albares
5,194,847 A 3/1993 Taylor et al.
5,335,208 A 8/1994 Sansone
5,349,458 A * 9/1994 Karlsson ..... 340/556
5,355,208 A * 10/1994 Crawford et al. ..... 250/227.19
5,694,114 A 12/1997 Udd
6,057,919 A * 5/2000 Machida et al. ..... 356/450

* cited by examiner

*Primary Examiner*—Thomas Mullen
(74) *Attorney, Agent, or Firm*—DeMont & Breyer, LLC

(57) ABSTRACT

An intrusion detector and method of operation which include a light source having a certain correlation length, and first and second light paths, wherein at least the first path extends through a secured area. A modulator, which is advantageously either a phase rotation modulator or path length modulator, is provided in the second path. At least one optical detector is placed to detect light traveling along the two paths. A comparator is electrically coupled to the detector to compare the detected signal with a signal applied to the modulator.

17 Claims, 5 Drawing Sheets

100

400

PHOTON INTRUSION DETECTOR

FIELD OF THE INVENTION

The present invention relates generally to intrusion detectors and, more particularly, to a low cost photon intrusion detector.

BACKGROUND OF THE INVENTION

Laser and light beam intrusion detectors are now employed extensively to protect against unauthorized intrusion into secured areas. Such detectors usually take the form of interferometers employing interference effects to detect disturbances. For example, it has been proposed to utilize a fiber loop with counter-propagating beams, and detect phase changes between the two beams and between one of the beams and a reference beam in order to detect a disturbance on the fiber loop. It was also proposed that a frequency or phase modulator could be inserted in the apparatus to improve sensitivity. (See U.S. Pat. No. 4,885,462 issued to Dakin, and U.S. Pat. No. 5,012,088 issued to Cole, et al.) It has also been suggested to propagate two light beams in the same direction in two fibers, and utilize one beam to measure a physical variable and the other beam as a reference. (See U.S. Pat. No. 5,004,913 issued to Kleinerman.) Use of two overlapping fiber loops has also been proposed to determine the position of any disturbance. (See U.S. Pat. No. 5,355,208 issued to Crawford et al.) Backscattered light in combination with a Mach-Zehnder interferometer may also be used for intrusion detection. (See U.S. Pat. No. 5,194,847 issued to Taylor et al.) Fiber optic vibration detectors have been suggested employing Michelson type interferometers with one fiber used to detect the vibration and another fiber used as a reference. (See U.S. Pat. No. 5,381,492 issued to Dooley et al.)

Secure information transmission systems have also been proposed employing a Mach-Zehnder or Sagnac interferometer where at least one of the light paths has a phase or path length modulator. (See U.S. Pat. No. 5,140,636 issued to Albares.) A random path length modulator may be inserted in the loop. (See U.S. Pat. No. 5,694,114 issued to Udd.)

For systems detecting physical intrusion in a secured place, it may be possible for an intruder to defeat the system by diverting the optical beam and injecting a substitute interference pattern. For high security applications, systems are often supplemented by using multiple beams and other detection schemes, which can be fairly costly.

It is desirable, therefore, to provide a low cost intrusion detector which is not vulnerable to beam diversion.

SUMMARY OF THE INVENTION

The present invention in one aspect is an intrusion detector which includes a light source having a certain correlation length, and first and second light paths, at least the first path extending through a secured area. A modulator selected from phase rotation and path length modulators is provided in the second path. At least one optical detector is placed to detect light generated by the two paths. A comparator is electrically coupled to the detector to compare the detected signal with a signal applied to the modulator.

In accordance with another aspect, the invention is a method for detecting an intruder including the steps of splitting light from a light source having a certain correlation length into a first and second optical path, at least the first path extending through a secured area. The light in the second path is modulated applying a signal to a phase rotation or path length modulator. Light produced by the two paths is detected and the detected signal is compared with the signal applied to the modulator.

It is to be understood that both the foregoing general description and the following detailed description are exemplary, but are not restrictive, of the invention.

BRIEF DESCRIPTION OF THE DRAWINGS

The invention is best understood from the following detailed description when read in connection with the accompanying drawings. It is emphasized that, according to common practice in the industry, the various features of the drawing are not to scale. On the contrary, the dimensions of the various features are arbitrarily expanded or reduced for clarity.

DETAILED DESCRIPTION

Figure 1:
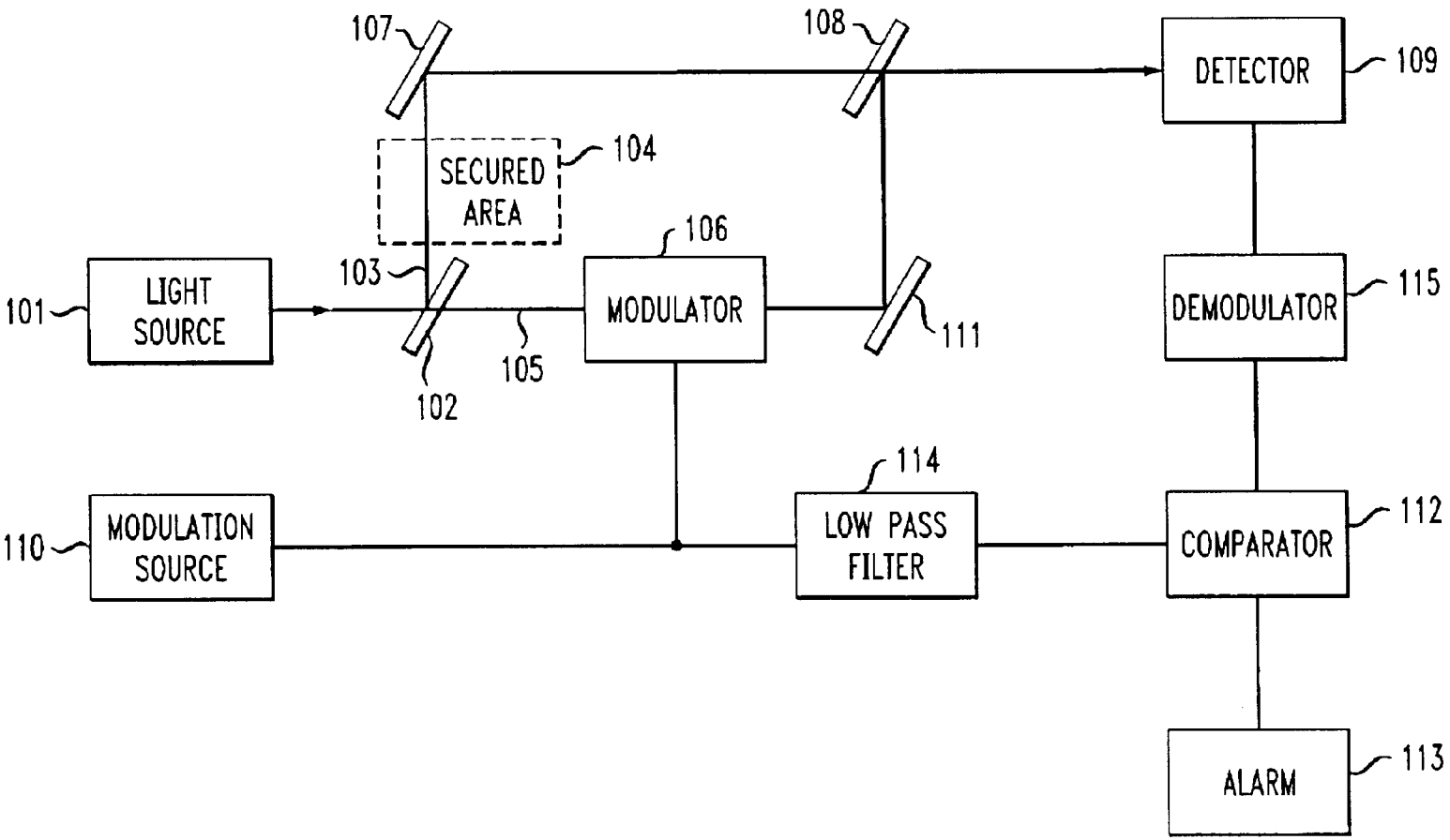
FIG. 1 is a schematic illustration of an intrusion detector in accordance with a first embodiment of the invention.

Referring now to the drawings, wherein like reference numerals refer to like elements throughout, FIG. 1 is a schematic illustration of intrusion detector 100, in accordance with an embodiment of the invention. The detector utilizes light source 101 having a known correlation length. As known in the art, the term "correlation length" is the length of a photon, and determines the amount of overlap (between two beams) that will produce interference. The correlation length will be a function of the light source and will generally be in the range of 1 millimeter (mm) to 30 centimeters (cm). In some embodiments, the light source is a light emitting diode having a wavelength in the infra-red or visible spectrum. Other light sources such as incandescent or fluorescent light can also be used.

The light from source 101 is incident on optical splitter 102, which splits the light, usually equally, into two beams that travel along light paths 103 and 105. One light path (e.g., light path 103) is directed through secured area 104. The secured area can be a room, a building, or any other structure that is to be protected from unauthorized physical intrusion.

Light path 103 is steered, either inside or outside the secured area, so that the beam is made incident on photodetector 109. In this example, the beam is steered by a combination of mirror 107 and optical combiner 108, but in other embodiments, other standard optical components can suitably be used.

Figure 2A:
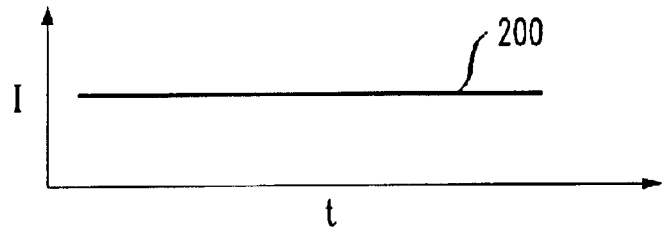
FIG. 2 is a schematic illustration of various waveforms utilized in the detector of FIG. 1.
Figure 2B:
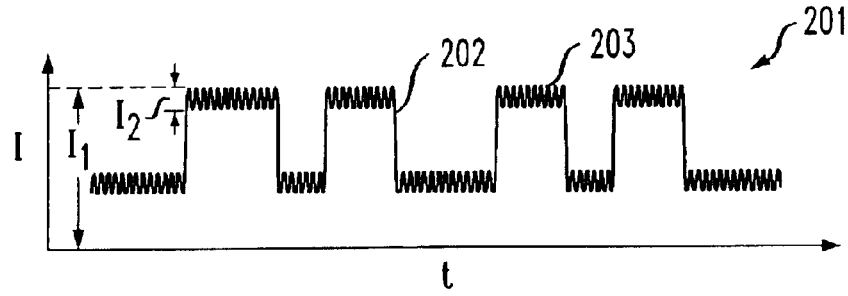

The other light path, light path 105, is directed to modulator 106. The modulator can be any standard optical component that changes either the optical path length or the phase rotation of the incident beam in response to an electrical signal from modulation source 110. For example, in some embodiments, modulator 106 is a crystal whose index of refraction is altered by the electrical signal. In some other embodiments, modulator 106 is one or more mirrors whose position or shape is modified by the source signal. Modulation source 110 is adapted to produce a random series of pulses, as illustrated by waveform 201 of FIG. 2B. Modulation source 110 is electrically coupled to low pass filter 114.

After passing through modulator 106, the beam in light path 105 is diverted by mirror 111 to combiner 108. The combiner combines the beam in light path 103 with the beam in light path 105. The combined beams are made incident on detector 109 (e.g., photodetector), which produces an electrical signal in response thereto.

The electrical output of the detector 109 is coupled to demodulator 115, which is, in turn, electrically coupled to one input of comparator 112. The other input of comparator 112 is electrically coupled to low pass filter 114. Alarm circuit 113 is advantageously electrically coupled to the output of comparator 112.

Although in this embodiment, light path 105 is wholly outside secured area 104, in some other embodiments, it is wholly or partially inside the secured area.

Figure 2C:
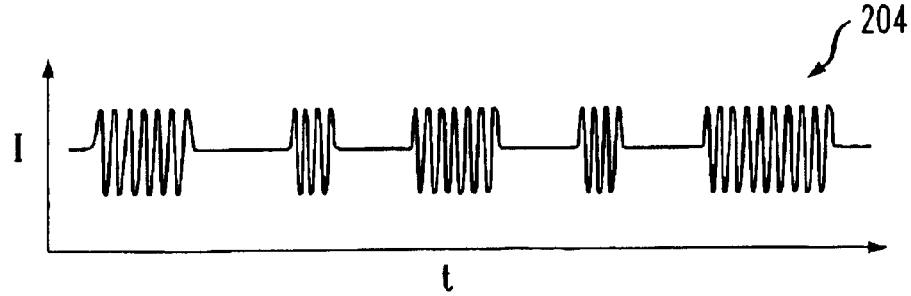
Figure 2D:
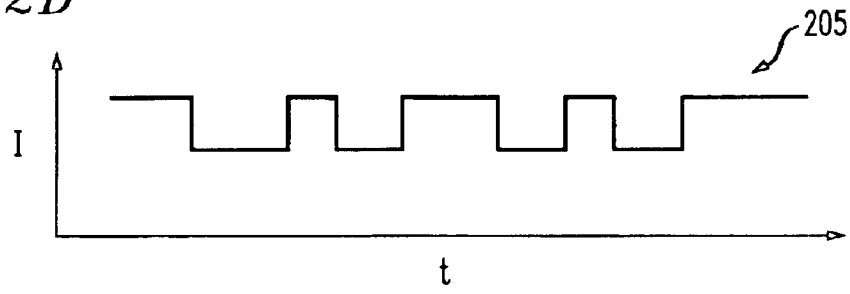
Figure 2E:
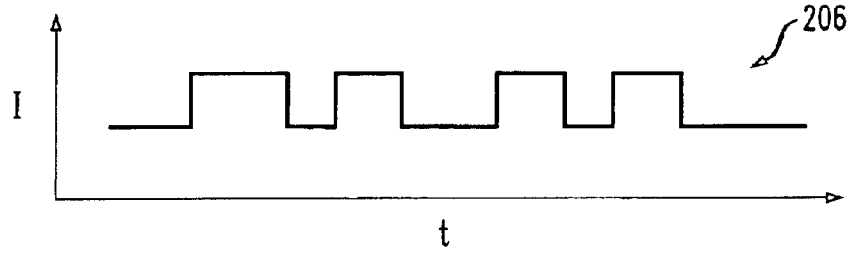
Figure 2F:
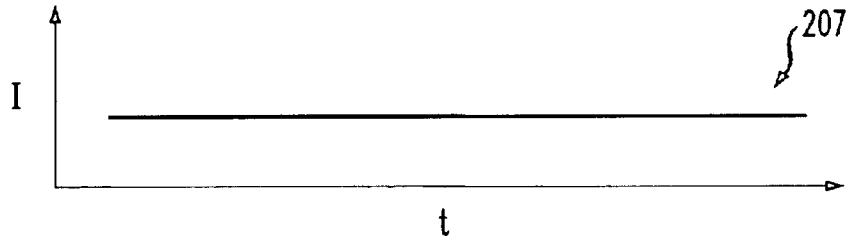
Figure 2G:
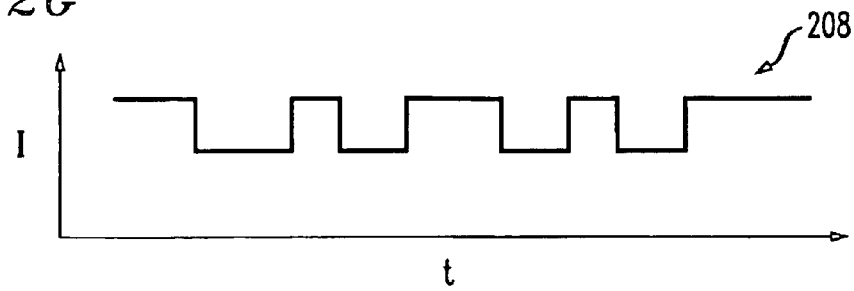
Figure 3:
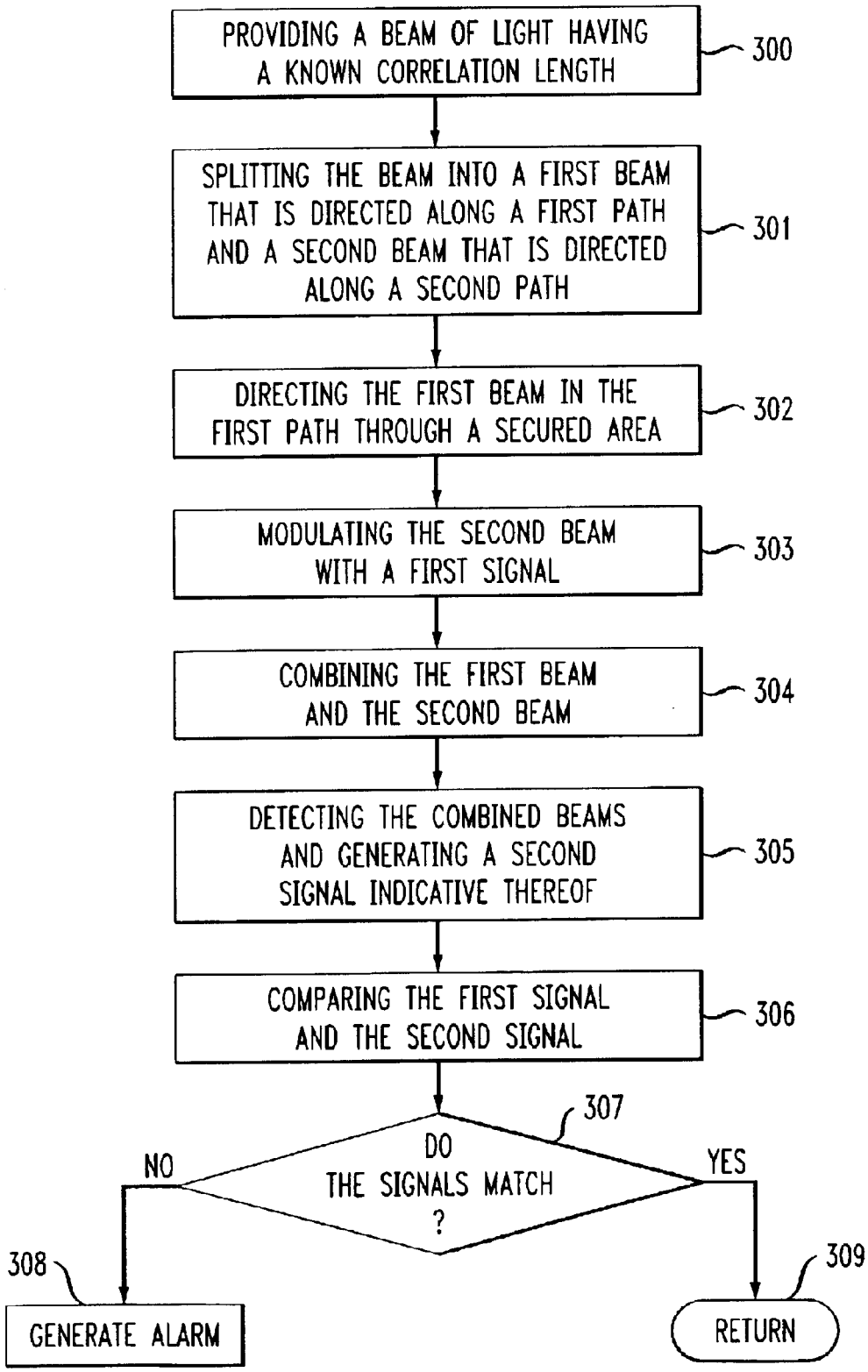
FIG. 3 is a flow diagram illustrating method aspects of the invention in accordance with an embodiment of the invention.

With further reference to the waveforms of FIG. 2 and the flow diagram of FIG. 3, in operation, light source 101 produces light having essentially constant intensity and a certain correlation length. This is illustrated by waveform 200 of FIG. 2A and task 300 of FIG. 3. The beam from light source 101 is split into two beams traveling along the two paths 103 and 105, as per task 301. The beam in one path (e.g., path 103) is directed through secured area 104, as illustrated in task 302. At the same time, the beam in path 105 is modulated by modulator 106 in response to the random pulses generated by modulation source 110, as illustrated by waveform 201 in FIG. 2B and task 303 in FIG. 3.

It will be noted that, in this embodiment, the signal from modulation source 110 comprises pseudo-random pulse width component 202, and, superimposed thereon, is band-limited signal 203, with a high rate of change of phase. It is desirable that the pseudo-random component has intensity $I_1$, which is much greater than the correlation length. For example, in some embodiments, the intensity is in a range of about 2 times to 10 times the correlation length. The band-limited component preferably has intensity $I_2$, which is approximately one-half the correlation length.

Assuming that there is no disturbance in path 103, the beams from paths 103 and 105 are combined by combiner 108, as illustrated in task 304, to produce the interference signal illustrated by waveform 204 in FIG. 2C. The interference signal is detected (per task 305) by detector 109. The detector generates an electrical signal in response thereto. After passing through demodulator 115, the signal is illustrated by waveform 205 of FIG. 2D. As illustrated by task 306, the detected signal is compared with the signal from modulation source 110 after the latter has passed through the low pass filter 114 (waveform 206 in FIG. 2E).

If the detected signal matches the modulating signal, as indicated by decision task 307, the detector continues to operate normally. In this example, the two signals are 180 degrees out of phase, and the resulting signal from the comparator is zero. Consequently, no alarm is generated. It will be noted that the signals "match" if the detected signal has some predetermined relationship with the signal from the modulation source.

If, however, the signals do not match, an alarm is generated, as per task 308, by alarm circuit 113. This mismatch can occur in a number of ways. If the beam in path 103 is blocked by an intruder, no interference pattern will be generated at detector 109. If an intruder attempts to divert the beam in path 103, the path length of path 103 will change. No interference pattern will be generated if the change in path length is greater than the correlation length of the photons.

These examples produce a detected signal after passing through demodulator 115, as illustrated by waveform 207 of FIG. 2F. It will be noted that, since no interference pattern is generated, the signal has an essentially constant intensity indicative of the light source 101. Since the detected signal no longer matches the signal from the modulation source (waveform 206), comparator 112 generates a signal, such as illustrated by waveform 208 of FIG. 2G, and an alarm results.

If the intruder is somehow able to change the path length by an amount less than the correlation length, or attempts to inject a bogus interference pattern, the pattern detected by detector 109 will not match the signal from modulation source 110, and, again, an alarm will be generated. In other words, even if a series of random pulses is generated by detector 109, these pulses will not cancel out the signal (206 of FIG. 2E) from modulation source 110 and an alarm signal will be generated.

Thus, it can be seen that the intrusion detector according to the invention provides enhanced security in a cost-effective manner.

Figure 4:
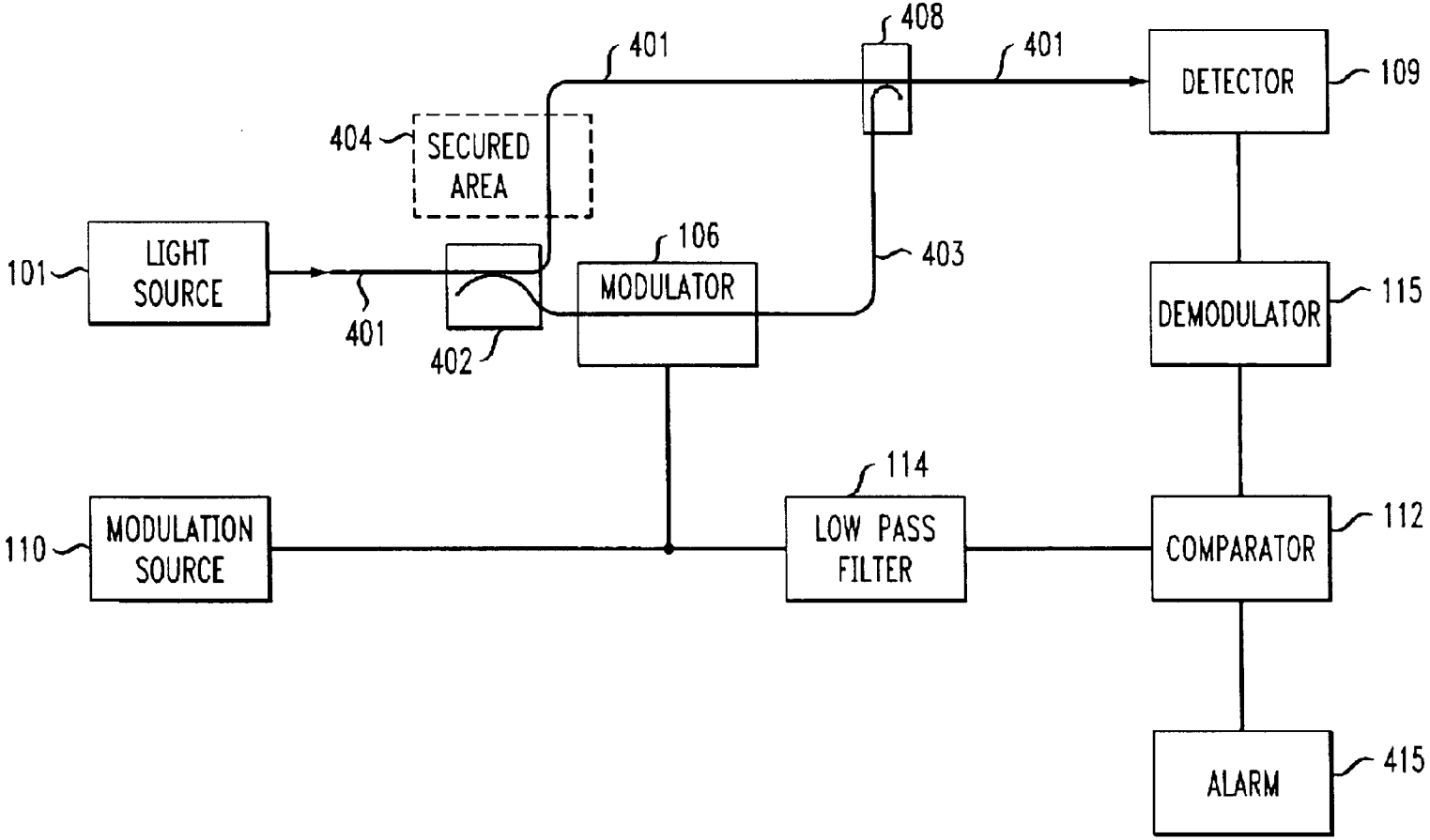
FIG. 4 is a schematic illustration of an intrusion detector in accordance with a second embodiment of the invention.

FIG. 4 is a schematic illustration of a detector in accordance with a further embodiment of the invention. It will be noted that this embodiment utilizes essentially the same components, which are numbered as in FIG. 1. The main difference is that the light beams are carried by optical fibers rather than free space. In particular, light from source 101 is carried by optical fiber 401 to optical coupler/splitter 402, where a portion of the light is coupled to optical fiber 403 and the remaining portion continues along fiber 401. About 50 percent of the initial light is "split off" to fiber 403. Fiber 401, which forms one of the light paths, is sent through secured area 404, while fiber 403, which forms the other light path, is sent through modulator 106.

After passing through modulator 106, the light beam in fiber 403 is recombined with the light in fiber 401 by optical splitter/combiner 408. The recombined beam in fiber 401 is coupled to detector 109 for detection of the resulting interference pattern, as before. The operation is otherwise as previously described.

One of the advantages of this embodiment is that secured area 404 can be fairly small, such as a container. The container would have a fiber attached to it. An intruder attempting to open the container would break the fiber and, as a result, no interference pattern would be formed at detector 109 and an alarm would be generated. Attempts to by-pass the fiber or inject a false pattern would also trigger an alarm for the reasons previously described.

Although the invention has been described with reference to exemplary embodiments, it is not limited to those embodiments. For example, although the embodiments described involve co-propagating beams, in some other embodiments, counter-propagating beams can be used. While in the illustrative embodiments, the comparator, demodulator, low pass filter, and alarm are illustrated as separate circuits, in some other embodiments, they are part of a single integrated circuit or several integrated circuits. Furthermore, in some other embodiments, the demodulator and low pass filter are replaced by other components that enable the signals in the two paths to be compared. Additionally, although the signals from the two paths are designed for total destructive interference in the illustrative embodiments when no intruder is present, other arrangements can be used. For example, if the light is not split equally, a dc component could be present even if the signals match. Rather, the appended claims should be construed to include other variants and embodiments of the invention which can be made by those skilled in the art without departing from the true spirit and scope of the present invention.

What is claimed:

1. An intrusion detector comprising:

a light source having a certain correlation length;

first and second light paths, at least the first path extending through a secured area;

a modulator disposed in said second light path, wherein said modulator is selected from phase rotation and path length modulators;

at least one optical detector positioned to detect light from said first and second light paths and operable to generate a first signal in response thereto; and a comparator electrically coupled to said optical detector to compare said first signal with a second signal applied to said modulator.

2. The detector according to claim 1 wherein said first light path and said second light path comprise free space.

3. The detector according to claim 2 further comprising light-steering components in at least said first light path.

4. The detector according to claim 1 wherein said first light path and said second light path comprise optical fibers.

5. The detector according to claim 1 wherein said light source comprises a light emitting diode.

6. The detector according to claim 5 wherein said correlation length is within a range 1 mm to 30 cm.

7. The detector according to claim 1 further comprising a source of said second signal, wherein said source is capable of providing random or pseudo-random pulses to the modulator.

8. The detector according to claim 7 further comprising:

a demodulator electrically coupled to said optical detector; and a low pass filter electrically coupled to said source of said second signal.

9. The detector according to claim 1 further comprising an alarm circuit.

10. The detector according to claim 1 wherein said second light path is wholly outside said secured area.

11. A method for detecting an intruder comprising:

splitting a light beam having a known correlation length into a first beam traveling along a first optical path and a second beam traveling along a second optical path, wherein at least said first optical path extends through a secured area;

modulating said second beam with a first signal;

combining said first beam and said second beam;

detecting light from the combined beams and generating a second signal in response thereto; and comparing said second signal with said first signal.

12. The method according to claim 11 wherein modulating further comprises modulating by a method selected from the group consisting of phase rotation modulation or path length modulation.

13. The method according to claim 11 wherein said first optical path and said second optical path comprise free space.

14. The method according to claim 11 wherein said first optical path and said second optical path comprise fiber.

15. The method according to claim 11 further comprising generating an alarm if said second signal does not match said first signal.

16. The method according to claim 11 wherein said second optical path is wholly outside the protected area.

17. The method according to claim 11 further comprising passing said second signal through a demodulator, and passing said first signal through a low pass filter.

* * * * *